United States Patent [19]

Backe et al.

[11] Patent Number: 4,499,757

[45] Date of Patent: Feb. 19, 1985

[54] DEVICE AND METHOD FOR LOCKING A DRIVE SHAFT DISPOSED IN A FUEL INJECTION PUMP FOR INTERNAL COMBUSTION ENGINES AND HOLDING BOLT THEREFOR

[76] Inventors: Egbert Backe, August-Lammle-Str. 7, 7145 Markgröningen; Rolf Müller, Adalbert-Stifter-Str. 8, 7000 Stuttgart 40; Dieter Otto, Breslauer Str. 3, 7141 Schwieberdingen; Cornelio Leonardi, Jägerhalde 108A, 7000 Stuttgart 60; Heinrich Kochendörfer, Schumannstr. 12, 7053 Kernen; Paul Füssner, Sommerhofenstr. 167, 7032 Sindelfingen; Ewald Walker, Im Wiesengrund 30, 7014 Kornwestheim; Rudi Rommel, Westendstr. 18, 7120 Bietigheim, all of Fed. Rep. of Germany

[21] Appl. No.: 438,226

[22] Filed: Nov. 1, 1982

[30] Foreign Application Priority Data

Jul. 8, 1982 [DE] Fed. Rep. of Germany ..... 3225553

[51] Int. Cl.[3] ..... F04B 21/00

[52] U.S. Cl. ..... 73/119 A; 417/63

[58] Field of Search ..... 73/119 A, 117.3; 123/343, 509, 369, 495; 74/527; 417/63

[56] References Cited

U.S. PATENT DOCUMENTS

| | | | |
|---|---|---|---|
| 3,702,577 | 11/1972 | Staudt et al. | 92/15 |
| 4,192,272 | 3/1980 | Lang | 123/343 |
| 4,385,867 | 5/1983 | Straubel | 123/509 X |

FOREIGN PATENT DOCUMENTS

| | | |
|---|---|---|
| 2949100 | 6/1981 | Fed. Rep. of Germany . |
| 1507902 | 4/1978 | United Kingdom . |
| 2065792 | 7/1981 | United Kingdom . |

*Primary Examiner*—Gerald Goldberg
*Assistant Examiner*—E. Harding

[57] ABSTRACT

An element firmly connected with the drive shaft of an injection pump is locked in a predetermined rotary position, corresponding to the supply onset, by a locking device before the mounting of the injection pump to the associated internal combustion engine, the locking being effected by means of a holding bolt embodied as a reversible part. The holding bolt, locked by a fastening means in a reception bore, engages a transverse groove on the end face, in a first mounting position, via a protrusion on the element firmly connected with the drive shaft, and thus establishes a form-locking connection which keeps the drive shaft in the predetermined rotary position. In a second mounting position of the holding bolt, where the transverse groove points outward, the rotary movement of the drive shaft is unhindered. By means of the locking device, an injection pump can be mounted on an engine in the correct association with the drive mechanism of the engine without additional expenditure being required for measurement and testing.

12 Claims, 5 Drawing Figures

DEVICE AND METHOD FOR LOCKING A DRIVE SHAFT DISPOSED IN A FUEL INJECTION PUMP FOR INTERNAL COMBUSTION ENGINES AND HOLDING BOLT THEREFOR

BACKGROUND OF THE INVENTION

The invention is based on a locking device and an associated holding bolt and method therefor as generally defined hereinafter.

In fuel injection pumps of the series type, it is necessary to adjust the supply onset position or a rotary position corresponding to supply onset, for instance of the first cam (counting beginning at the drive mechanism) of the camshaft which here represents the drive shaft and then to lock the camshaft in place, in order to be able to mount the injection pump to the appropriately prepared internal combustion engine. In fuel injection pumps of the distributor type, the drive shaft is locked in the rotary position in which a particular outlet begins to supply fuel, or else it is locked in a position which is offset from this rotary position by a constant amount.

In order to mark this supply onset position fixed on the test bench, it has previously been conventional to provide a slash mark on some elements firmly connected with the drive shaft and to provide a second slash mark, agreeing with the first, on the end face of the pump or on the movable part, if the fixed mark is located on the pump housing. This known manner of adjustment has, among others, the grave disadvantage that the slash marking is difficult or impossible to see from outside if the pump is mounted with an end flange to the gear box of the internal combustion engine. In that case, it is frequency necessary to ascertain the supply onset anew once the pump has been mounted on the engine. This can be accomplished by the so-called "overflow method": with the pressure valve removed, the pump suction chamber is placed under fuel pressure, and with the drive shaft coupled to the pump and stationary the pump is pivoted slowly until such time as the pump piston, upon its upward stroke, closes the intake bore and the fuel stops flowing out. In this position, the injection pump is firmly screwed to the engine, which has already been adjusted to supply onset. This type of adjustment method is very time consuming and can be performed only by experienced personnel. However, even if the slash mark is accessible, the adjustment when the pump is mounted on the engine is very much dependent upon the skill of the mechanic.

It is true that a device of the general type is-also known (German Offenlegungsschrift No. 29 49 100), in which a spring-loaded holding bolt of a locking device which is positionally fixed with respect to the pump housing is pressed by means of a transverse groove on the end face onto a protrusion at the circumference of some element connected with the camshaft of the injection pump, in order to lock the camshaft in the supply onset position during mounting on the engine. The apparatus disclosed there is very expensive and labor-intensive, and the structural unit receiving the holding bolt in a guide bushing must absolutely be removed following the mounting of the injection pump on the engine, and the hollow screw which has been used must be replaced by a closure screw. These devices are then returned by the engine builder to the manufacturer of the injection pump and are used again. This procedure can bring about additional costs and also has the disadvantage that if the injection pump is repaired and then remounted on the engine, the rotary position of the camshaft corresponding to supply onset must be found once again or reascertained by means of a new device which may possibly have different dimensional tolerances. It is the object of the invention to develop a highly simplified locking device which satisfies the demands placed upon it, is inexpensive to manufacture and can remain in place on the injection pump such that it will not be lost and yet will have no disadvantageous effect on engine operation even after the injection pump has been mounted on the engine.

OBJECT AND SUMMARY OF THE INVENTION

In the locking device according to the invention, the holding bolt comprises a simple component which can be manufactured inexpensively, for which neither guide nor spring elements have to be used; in terms of the depth of insertion, the holding bolt is not vulnerable to dimensional tolerances of either the bore or the bolt, because of the transverse groove which is equipped with parallel flanks or inner side surfaces.

By means of further characteristics disclosed hereinafter, advantageous further developments of and improvements to the locking device are possible. By means of the principles of the invention, it is attained that the holding bolt can always remain on the injection pump; if repair should become necessary the injection pump can be remounted on the engine once repair is finished, without great expense for measuring instruments, using the holding bolt which can be removed for repair and then easily replaced. The pump is mounted on the engine by using the holding bolt in its first mounting position, the drive shaft being locked thereby. A supply onset signal no longer needs to be picked up by corresponding pulse transducers and measuring instruments, thus eliminating a rather large number of potential causes for error, so that the entire process of mounting the pump to the engine is simplified substantially and made substantially less expensive.

By means of the characteristics disclosed hereinafter, the mechanic mounting the pump is made aware of a given mounting position of the holding bolt in a simple and effective manner, thus preventing the engine from being put into operation while the drive shaft is still locked. Also, the locking device is not vulnerable to the effects of a displacement in the level of the longitudinal axis of the guide bore relative to the axis of the drive shaft. Further, an extremely inexpensive fabrication of the holding bolt is attained, while at the same time destructiion is prevented of important components should the holding bolt mistakenly be left in its first mounting position and should the engine nevertheless be started at such a time. The extremely inexpensive holding bolt, in that event, can then easily be replaced with a new one.

The invention will be better understood and further objects and advantages thereof will become more apparent from the ensuing detailed description of three preferred embodiments taken in conjunction with the drawings.

DESCRIPTION OF THE PREFERRED EMBODIMENTS

Figure 1:
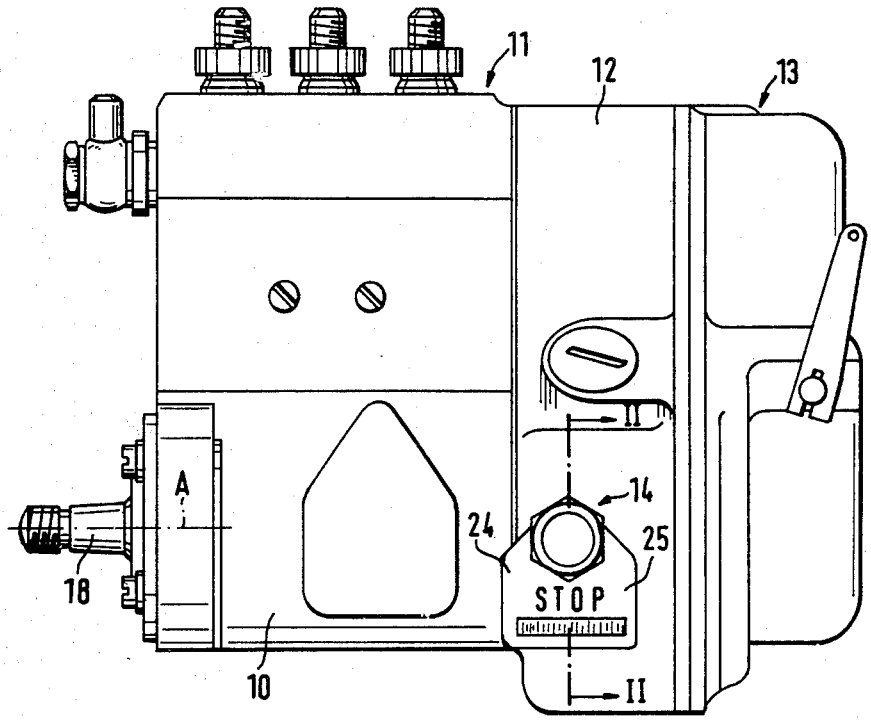
FIG. 1 is a side view of the fuel injection pump provided with the first exemplary embodiment of the locking device located in the vicinity of the pump governor.
Figure 2:
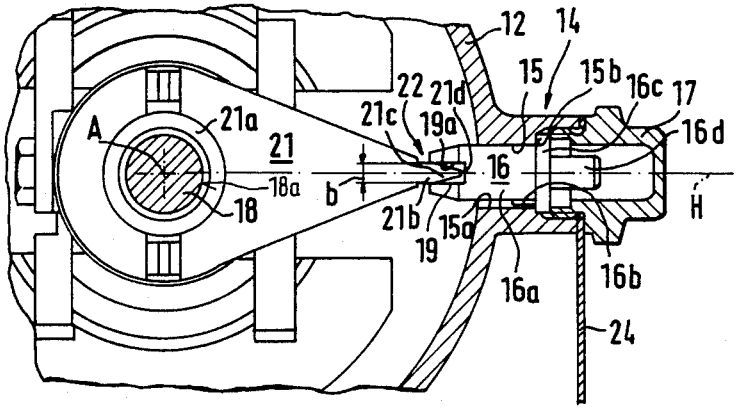
FIG. 2 is a partial cross-section taken along the line II—II of FIG. 1 with the drive shaft locked.
Figure 3:
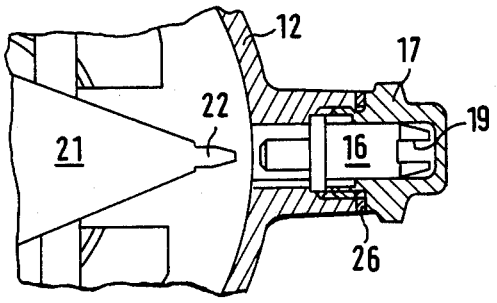
FIG. 3 is a partial section corresponding to FIG. 2, but with the drive shaft having been released and with the holding bolt used in its second mounting position.

In the first exemplary embodiment shown in FIGS. 1–3, a locking device 14 is secured, being positionally fixed with respect to the pump housing 10, on a governor housing 12 of a centrifugal governor 13, the governor housing 12 being firmly connected to the pump housing 10 of a fuel injection pump 11 (see FIG. 1). The locking device 14, as can be seen in greater detail in FIG. 2, substantially comprises a holding bolt 16 inserted into a reception bore 15 of the governor housing 12 and a cap screw 17 serving as a fastening means for the holding bolt 16. The reception bore 15 is directed radially with respect to the center A of the axis of a drive shaft 18, which in the present case is embodied by the camshaft of the injection pump 11.

With one end section of a cylindrical section 16*a*, the holding bolt 16 protrudes beyond the guide bore 15 and into the interior of the governor housing 12 and in its first mounting position shown in FIG. 2 engages via a transverse groove 19, cut on the end face into the cylindrical section 16*a*, a protrusion 22 disposed on an element 21 firmly connected with the drive shaft 18, and thus provides a form-locking connection between the holding bolt 16 and the element 21.

The element 21 firmly connected with the drive shaft 18 is embodied in the form of a pointer, having an annular hub 21*a* on a fastening cone 18*a* of the drive shaft 18 with which it is immovably secured in a predetermined rotary position corresponding to or associated with the supply onset of the injection pump, and on its outermost end adjoining a key element 21*b* encompassed by the transverse groove 19 of the holding bolt 16, it has a pointer-like tip 21*c* with an angle-indicating marking 21*d*. The protrusion 22 thus serves both as a coupler element of the locking device 14 and also as a pulse trigger means for an electric pulse transducer (not shown), which can be inserted in place of the holding bolt 16 into the reception bore 15 in order to ascertain the predetermined rotary position of the drive shaft 18 and which functions in a non-contacting manner. The holding bolt 16 is preferably fabricated as a cast plastic element, and it is secured against twisting, in its first mounting position shown in FIG. 2, by a rotary-position fixation means 23. This rotary-position fixation means 23 comprises a protrusion 16*b* engaging a longitudinal groove 15*a* of the reception bore 15 and molded onto the cylindrical section 16*a* of the holding bolt 16.

Adjacent to the cylindrical section 16*a*, the holding bolt has a holding collar 16*c* of greater diameter, which is firmly clamped by the cap screw 17, resting on a step 15*b* of the reception bore 15, in its first or second mounting position shown in FIGS. 2 and 3, respectively. The holding bolt further has a tang 16*d* on its end opposite the cylindricylindrical section 16*a*, which is adjacent to the holding collar 16*c* in the axial direction and is shorter in comparison with the cylindrical section 16*a* by at least the depth of insertion of the protrusion 22 into the trnasverse groove 19. Pointing outward, this tang 16*d* identifies the first mounting position of the holding bolt 16 and can be used to draw the bolt 16 out of its reception bore 15.

The transverse groove 19 cut in the form of an open slit in the cylindrical sectiion 16*a* has two flanks 19*a* which are parallel to a longitudinal axis H of the holding bolt 16 and to the longitudinal axis A of the drive shaft 18; the space between these flanks 19*a* corresponds to the width b of the key element 21*b* on the protrusion 22.

The holding bolt 16 is embodied as a reversible part, and in its first mounting position (see FIG. 2) it engages via the transverse groove 19, the protrusion 22 of the element 21 firmly connected with the drive shaft 18 and locks the drive shaft 18 in the predetermined rotary position corresponding to or associated with the supply onset. Before the injection pump 11 is put into operation, the holding bolt 16 must be reversed after the cap screw 17 has been removed; the holding bolt 16 is then in its second mounting position shown in FIG. 3, in which the protrusion 22 is free and thus no longer locks the drive shaft 18 in position. In the second position the transverse groove 19 points radially away from the drive shaft 18. In order to assure that after the injection pump 11 has been mounted to an associated engine the holding bolt 16 will not mistakenly remain in its first mounting position in which the drive shaft 18 is locked in position, a warning and indicator label 24 indicating the mounting position is secured to the locking device 14 (shown in FIGS. 1 and 2) by means of the cap screw 17. This warning 24 is either colored by a red signal color or is fabricated of red plastic, and its carries a warning inscription 25 which may comprise the words "STOP" or "WARNING" and/or may include the notation "governor locked."

If the holding bolt 16 is in its second mounting position shown in FIG. 3, then the label 24 is removed and replaced with a sealing ring 26.

Figure 4:
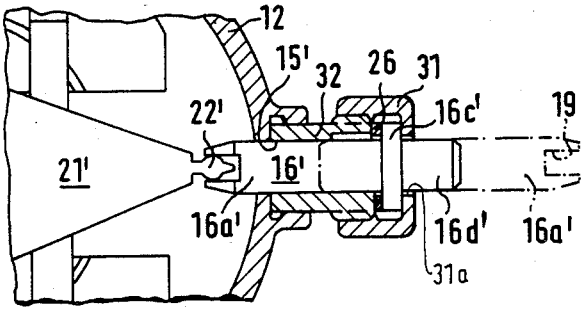
FIG. 4 is a sectional view corresponding to FIG. 2 but for a second exemplary embodiment.

In the second exemplary embodiment shown in FIG. 4, the holding bolt 16' is locked in a given mounting position by means of a sleeve nut 31 serving as the fastening means. In both mounting positions, the sealing ring 26 is placed between the collar 16*c'* and a guide bushing 32 used here. The first mounting position is shown here by means of the holding bolt 16' drawn with solid lines. Its second mounting position is indicated by dot-dash lines. Since in the second mounting position the longer, cylindrical section 16*a'* provided with the transverse groove 19 is passed all the way through an opening 31*a* in the base of the sleeve nut 31 and protrudes axially beyond the sleeve nut 31 by a substantial amount, and since the first mounting position is preferably made recognizable by red coloring on the tang 16*d'*, the mounting position of the holding bolt 16' at a given time can be ascertained with assurance.

In the case of the element firmly connected with the drive shaft 18, which here is designated as element 21', the protrusion 22' differs from the protrusion 22 shown in FIGS. 2 and 3 in that it is convex in embodiment, so that imprecision in the position of the holding bolt 16' will not have disadvantageous effects and also so that it is possible to have a shift in level of the associated reception bore 15'. The guide bushing 32, which has a thread for the sleeve nut 31, is poured into the governor housing 12 in the form of a poured element, which in certain cases permits more favorable fabrication; however, this element may also be embodied as an element for screw insertion. Naturally the holding bolt 16', like the holding bolt 16 of the first exemplary embodiment.

can be secured by means of a hollow screw in a cast-on eye of the governor housing 12.

Figure 5:
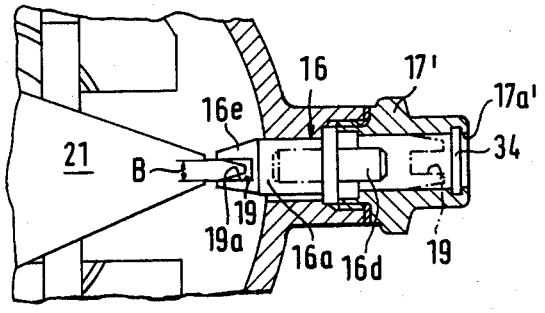
FIG. 5 shows a third exemplary embodiment in a partial section corresponding to FIGS. 2 and 3.

The third exemplary embodiment shown in FIG. 5 differs from the embodiments shown in FIGS. 1–3 solely in that it has a cap screw 17' provided with a viewing window 34. The viewing window 34, fabricated of transparent glass or Plexiglas, closes an opening 17*a'* in the base of the cap screw 17' and is fastened by means of a crimping procedure or by a riveting procedure. Through the viewing window 34, it can be ascertained whether the holding bolt 16, with its tang 16*d* pointing outward, is in its first mounting position in which it locks the drive shaft 18 or, with the transverse groove 19 pointing outward, whether it is in its second mounting position indicated by dot-dash lines, in which the injection pump can be put into operation without any danger of damaging important components. The first mounting position indicated by solid lines can also be made more clearly recognizable by providing the tang 16*d* with a red signal color. Naturally, the cap screw 17' can also be fabricated entirely of transparent plastic.

As may be seen from FIG. 5, and which is also applicable to the other exemplary embodiments, the two wall portions of the cylindrical section 16*a* of the holding bolt 16 which carry the flanks 19*a* of the transverse groove 19 and are marked 16*e* are each equipped with a reduced wall thickness to provide a safety breaking point; this wall thickness is preferably less than the width B of the transverse groove 19. This reduced wall thickness on the holding bolt 16, which is fabricated of plastic, additionally represents an overload safety means, because if the injection pump is mistakenly put into operation with the holding bolt 16 in its first mounting position, the thin-walled portions 16*e* are sheared off by the element 21, which is fabricated of steel, before any other important component suffers damage. A destroyed holding bolt 16 can easily be replaced with a new one without notable cost.

The following should also be noted on the mode of operation of the device according to the invention:

Prior to the mounting of the holding bolt 16, 16' shown in FIGS. 1 and 2 or 4 and 5, the element 21, 21' firmly connected with the drive shaft 18 is secured on the drive shaft 18 in a separate test procedure during the fabrication of the injection pump, in the position shown in FIGS. 2–5 and in which its protrusion 22, 22' is located in the direction of the longitudinal axis H of the holding bolt 16, 16'. Prior thereto, the drive shaft 18 was brought into a rotary position either corresponding with the supply onset of a particular pump cylinder or associated with a fixed angular offset. With the drive shaft 18 locked in place by the holding bolt 16, 16', the injection pump is mounted on the associated engine, the drive mechanism of which has been previously adjusted into a position corresponding to the adjustment of the injection pump. Once the injection pump 11 has been mounted to the associated engine, then after the cap screw 17, 17' or the sleeve nut 31 has been loosened, the holding bolt 16 or 16' is rotated into the position shown in FIG. 3, or as indicated by dot-dash lines in FIGS. 4 and 5 and is again locked in this position.

If the rotary position of the drive shaft 18 corresponding to or associated with the supply onset is to be monitored precisely, then the holding bolt 16, 16' can be removed, after the removal of the cap screw 17, 17' or of the sleeve nut 31, and can be replaced with an electrical pulse transducer functioning in a non-contacting manner, which is then introduced into the reception bore 15 in place of the holding bolt 16, 16' and emits a measurement signal referring to some reference marking applied to the engine, this marking preferably being capable of being electrically scanned in a known manner. Such monitoring may become necessary during regular maintenance, for instance after the engine has been used for a particular period of time.

Following any repair of the injection pump 11, in which the pump drive elements have not, however, been disassembed nor has the governor been removed, the rotary position of the drive shaft 18 associated with the supply onset can be relocated in a simple manner, without using a test bench, for the purpose of remounting the injection pump on the engine. The drive shaft 18 is rotated until the protrusion 22, 22' carrying the angle-indicating marking 21*d* is located precisely in the center of the axis of the reception bore 15, 15'. The holding bolt 16, 16' can then be inserted into a first mounting position and the pump can be mounted onto the engine. After this mounting has been completed, the holding bolt 16, 16' is then placed in its above-described second mounting position and secured there.

The foregoing relates to preferred exemplary embodiments of the invention, it being understood that other embodiments and variants thereof are possible within the spirit and scope of the invention, the latter being defined by the appended claims.

What is claimed and desired to be secured by letters patent of the United States is:

1. A device for locking a drive shaft (18) disposed in a fuel injection pump for internal combustion engines in a predetermined rotary position corresponding to supply onset, having a locking device (14) which is positionally fixed with respect to the pump housing (12) and provided with a fastening means (17) the locking device (14) having a holding bolt (16, 16') inserted into a reception bore (15, 15') pointing radially toward the center of the axis of the drive shaft, the holding bolt having a transverse groove (19) located on its end face in a cylindrical section (16*a*, 16*a'*), wherein a form-locking connection holding the drive shaft in the predetermined rotary position is arranged with a protrusion (22, 22') of an element (21, 21') firmly connected with the drive shaft comprising:

(a) a holding collar (16*c*) adjoining the cylindrical section (16*a*, 16*a'*) of the holding bolt;

(b) the fastening means (17, 17', 31) firmly clamping the holding collar against a step (15*b*) within the reception bore (15, 15');

(c) the transverse groove (19) comprises an open slit having two flanks 19*a* parallel with the longitudinal axis (H) of the holding bolt and with the longitudinal axis (A) of the drive shaft;

(d) the protrusion (22, 22') having a width (b) corresponding to the distance between the parallel flanks (19*a*) of the transverse groove, and (e) wherein the holding bolt, in a first mounting position serving to lock the drive shaft, engages the protrusion via the transverse groove and, in a second mounting position, in which the protrusion is released, the holding bolt is reversed from its first position and disengaged from the protrusion, the transverse groove pointing radially away from the drive shaft.

2. A device as defined by claim 1, further comprising, a warning and indicator label (24) secured on the locking device for identifying the locked rotary position of the drive shaft in the first mounting position of the holding bolt, and a sealing ring (26) for replacing the indicator label in the second mounting position of the holding bolt.

3. A device as defined by claim 1, further comprising, a means defining an opening in the base of the fastening means whereby in the second mounting position of the holding bolt, at least a portion of the cylindrical section carrying the transverse groove is visible and protrudes through the opening.

4. A device as defined by claim 1, further comprising, a viewing window (34) in the fastening means, whereby the mounting position of the holding bolt at a given time is visible through the window.

5. A device as defined by claim 4, wherein the mounting position of the holding bolt as a given time is recognizable by means of a different coloring of its variously visible end sections (16*a*, 16*a'*, 16*d*).

6. A device as defined by claim 1, wherein the holding bolt, on its end opposite the cylindrical section, comprises a tang (16*d*) axially adjoining the holding collar and being shorter by at least the insertion depth of the protrusion in the transverse groove (19) in comparison with the cylindrical section.

7. A device as defined by claim 1, wherein the holding bolt and the reception bore comprise a rotary-position fixing means (23) for assuring the correct position of the transverse groove in the first mounting position.

8. A device as defined by claim 1, wherein the protrusion on its outermost end adjoining a key element (21*b*) is insertable into the transverse groove and comprises a pointer-like tip (21*c*) having an angle-indication marking (21*d*), whereby the pointer-like tip serves both as a coupler element for the locking device and as a pulse-triggering means for an electrical pulse transducer in place of the holding bolt in order to ascertain the predetermined rotary position of the drive shaft.

9. A device as defined by claim 8, wherein the protrusion is convex.

10. A device as defined by claim 1 wherein the holding bolt comprises a molded plastic element serving as an overload safety means.

11. A device as defined by claim 10, wherein both wall portions (16*e*) carrying the flanks (19*a*) of the transverse groove have a reduced wall thickness, preferably being less than the width of the transverse groove.

12. A method for mounting a fuel injection pump on an internal combustion engine in a correct association with the drive mechanism of the engine, in particular for operating a locking mechanism for the drive shaft disposed in the injection pump, wherein the drive shaft is locked in a predetermined rotary position corresponding to a fuel supply onset before the injection pump is put into operation, comprising the steps of, providing a visible warning on the injection pump of its locked condition, and eliminating the locked condition by reversing the locking mechanisnm to a non-operative position on the pump after the pump is mounted on the engine.

* * * * *